US011248888B2

(12) United States Patent
Mackenzie

(10) Patent No.: US 11,248,888 B2
(45) Date of Patent: Feb. 15, 2022

(54) PNEUMATIC FIREARM BARREL CLEANERS

(71) Applicant: Wyoming Wildside LLC, Alta, WY (US)

(72) Inventor: Dana Mackenzie, Alta, WY (US)

(73) Assignee: Wyoming Wildside LLC, Alta, WY (US)

( * ) Notice: Subject to any disclaimer, the term of this patent is extended or adjusted under 35 U.S.C. 154(b) by 114 days.

(21) Appl. No.: 16/744,777

(22) Filed: Jan. 16, 2020

(65) Prior Publication Data

US 2020/0182595 A1 Jun. 11, 2020

Related U.S. Application Data

(63) Continuation-in-part of application No. 15/922,728, filed on Mar. 15, 2018, now Pat. No. 10,551,155.

(60) Provisional application No. 62/482,654, filed on Apr. 6, 2017, provisional application No. 62/478,854, filed on Mar. 30, 2017.

(51) Int. Cl.

| | |
|---|---|
| ***F42B 5/24*** | (2006.01) |
| ***F42B 6/10*** | (2006.01) |
| ***F41A 29/00*** | (2006.01) |

(52) U.S. Cl.

CPC ..... *F42B 6/10* (2013.01); *F41A 29/00* (2013.01)

(58) Field of Classification Search

CPC .. F42B 5/24; F42B 14/00; F42B 14/04; F41A 29/00; F41B 11/62

USPC ..... 42/95; 102/440, 442, 529; 124/57

See application file for complete search history.

(56) References Cited

U.S. PATENT DOCUMENTS

| | | | | | |
|---|---|---|---|---|---|
| 3,209,690 | A * | 10/1965 | Mercatoris, Jr. | F42B 5/24 | 102/442 |
| 3,476,047 | A * | 11/1969 | Davis | F42B 5/24 | 102/442 |
| 3,740,883 | A * | 6/1973 | Kyle | F42B 5/24 | 42/95 |
| 3,830,214 | A * | 8/1974 | Curtis | F41B 11/62 | 124/57 |
| 4,328,632 | A | 5/1982 | Beers | | |
| 4,843,750 | A | 7/1989 | Blase | | |
| 4,998,368 | A | 3/1991 | Blase | | |
| 5,341,744 | A | 8/1994 | Shi | | |
| 5,378,499 | A * | 1/1995 | Martin | C23C 24/045 | 427/203 |
| 5,421,263 | A * | 6/1995 | Ruohonen | F42B 5/24 | 102/435 |
| 5,628,136 | A * | 5/1997 | Wickser, Jr. | F41A 29/02 | 42/95 |
| 5,777,258 | A * | 7/1998 | Soon | F42B 5/24 | 102/442 |
| 6,389,978 | B1 | 5/2002 | Hooper et al. | | |
| 6,619,278 | B1 | 9/2003 | Lin | | |
| 6,668,480 | B1 * | 12/2003 | Riley | F41A 29/00 | 15/3.5 |

(Continued)

OTHER PUBLICATIONS

International Search Report and Written Opinion of PCT/US2018/025018 dated Jun. 6, 2018.

*Primary Examiner* — Michael D David

(74) *Attorney, Agent, or Firm* — Elevated IP, LLC

(57) ABSTRACT

Propulsion systems, puncturing devices, and firearm barrel cleaners that use these components to propel cleaning and/or lubricating projectiles down the barrel of a firearm are disclosed, along with related methods of manufacture and use.

20 Claims, 15 Drawing Sheets

(56) References Cited

U.S. PATENT DOCUMENTS

| | | | | |
|---|---|---|---|---|
| 7,194,960 | B2 * | 3/2007 | Vasel | F41B 11/62 102/367 |
| 7,451,707 | B1 * | 11/2008 | Hadden | F41A 29/02 102/442 |
| 7,526,998 | B2 * | 5/2009 | Vasel | F42B 7/08 102/370 |
| 7,788,837 | B2 * | 9/2010 | Binek | F42B 5/24 42/95 |
| 8,051,776 | B1 * | 11/2011 | Bailey | F42B 3/006 102/442 |
| 8,146,284 | B2 * | 4/2012 | Smith | A46B 5/0095 42/95 |
| 8,196,330 | B2 * | 6/2012 | Smith | B08B 1/00 42/95 |
| 8,677,671 | B2 * | 3/2014 | Smith | F41A 29/00 42/95 |
| 8,763,298 | B2 * | 7/2014 | Smith | A46B 9/06 42/95 |
| 8,925,235 | B2 * | 1/2015 | Buie, II | F41A 29/02 42/95 |
| 9,052,172 | B2 * | 6/2015 | Whitworth | F42B 14/00 |
| 9,115,947 | B2 * | 8/2015 | Williams | F41A 29/02 |
| 9,194,674 | B2 * | 11/2015 | Whitworth | F42B 5/24 |
| 9,664,487 | B2 * | 5/2017 | Whitworth | F42B 14/00 |
| 10,018,455 | B2 * | 7/2018 | Whitworth | F42B 5/24 |
| 2014/0109791 | A1 | 4/2014 | Whitworth | |
| 2018/0283833 | A1 * | 10/2018 | Mackenzie | F41A 29/02 |

* cited by examiner

PNEUMATIC FIREARM BARREL CLEANERS

CROSS-REFERENCE TO RELATED APPLICATIONS

This application is a continuation-in-part of U.S. patent application Ser. No. 15/922,728, filed Mar. 15, 2018, now U.S. Pat. No. 10,551,155, which claims the benefit of and priority to U.S. Provisional Patent Appl. Nos. 62/478,854, filed Mar. 30, 2017, and 62/482,654, filed Apr. 6, 2017, all of which are hereby incorporated by reference in their entireties.

BACKGROUND

It is well known that dirt, debris, rust and powder residue within a firearm barrel negatively affect firing precision and can lead to dangerous misfires. Even so, most firearms are not cleaned and lubricated in accordance with manufacturers' recommendations because traditional processes for cleaning and conditioning firearms are tedious, physically demanding and equipment intensive.

A number of documents describe devices intended to overcome the problems associated with traditional firearm cleaning systems. For example, U.S. Pat. No. 6,389,978 discloses a shotgun shell containing a pressurized gas cartridge comprising an internal strike pin for puncturing a far end of the gas cartridge in order to propel a cleaning wad from the end of the shell; U.S. Pat. No. 5,341,744 discloses a shotgun shell including a gas cartridge configured to be pushed into a rupturing pin near a far end of the cartridge in order to propel a cleaning wad through a firearm bore; U.S. Pat. Nos. 4,843,750 and 4,998,368 disclose a cleaning wad attached to a compressed gas cartridge placed directly into a firearm chamber; U.S. Pat. No. 4,328,632 discloses a casing containing several barrel cleaning layers and a compressed gas cartridge that is propelled down the barrel with the cleaning layers; and U.S. Pat. No. 6,619,278 discloses a compressed gas system for launching non-lethal ammunition.

SUMMARY

The present invention generally relates to pneumatic devices and related methods of manufacture and use. As described herein, the pneumatic devices are configured as firearm barrel cleaning devices that propel cleaning and/or lubricating projectiles through the barrel of a firearm, without using powder primers, which would leave a residue and diminish the cleaning effect of the device. However, the disclosed devices and components may also be used in other technological areas. For example, the propulsion systems and/or puncturing devices disclosed herein may be used in medical devices, such as punch biopsy devices, finger pricking devices and aerosolizers.

The devices disclosed herein comprise propulsion systems configured for insertion into containers or casings. The propulsion systems include one or more vents for directing a flow of gas from a bottom end of a gas container toward a top end of the gas container between the walls of the propulsion system and the casing. The diameter and/or length of the propulsion system, as well as the size and/or pressure of the gas container may be selected to be of an appropriate scale for the container or casing. For firearm cleaning applications, the casing of the firearm barrel cleaning device will be substantially the same type and caliber as the casing used for ammunition of the firearm or armament to be cleaned. Thus, the propulsion systems, puncturing devices, projectiles and firearm barrel cleaning devices disclosed herein may be provided in a variety of sizes.

In an aspect, a propulsion system comprises a tube at least partially housing a gas container with at least one end region of the tube extending beyond the gas container, where the tube comprises at least one vent in the at least one end region.

In an embodiment, the gas container is disposed at a mid-section of the tube such that the tube comprises a second end region. Optionally, the tube comprises at least one vent in the second end region of the tube.

In an embodiment, the propulsion system is symmetrical across a central horizontal plane, a central longitudinal plane or both a central horizontal plane and a central longitudinal plane of the propulsion system.

In an embodiment, the tube is made of a material selected from a metal, a metal alloy, a plastic, an elastomer, wood, cardboard, carbon fiber and combinations thereof. Exemplary materials for the tube include, but are not limited to, aluminum, titanium, brass, silver, gold, platinum, stainless steel, Tygon® and rubber.

In an embodiment, the tube has an outer diameter selected from 0.1 inches to 24 inches, or from 0.1 inches to 12 inches, or from 0.1 inches to 6 inches, or from 0.1 inches to 2 inches, or from 0.1 inches to 1 inch, or from 0.1 inches to 0.8 inches, or from 0.1 inches to 0.73 inches. The outer diameter of the tube is typically selected to be equal to or less than the smallest inner diameter of a casing for housing the tube. In an embodiment, the tube has an outer diameter substantially equal to the inner diameter of a standard firearm casing neck. In an embodiment, the casing may be a firearm casing configured with a center firing mechanism or a large armament casing that utilizes an electronic firing device. In some embodiments, the outer diameter of the tube is about 9 mm caliber, 44 magnum caliber, .223 caliber, .264 caliber, 30-06 caliber, .410 gauge, 20 gauge, 16 gauge or 12 gauge.

In an embodiment, the tube has a length selected from 0.2 inches to 10 feet, or from 0.2 inches to 5 feet, or from 0.2 inches to 3 feet, or from 0.2 inches to 1.5 feet, or from 0.2 inches to 8 inches, or from 0.5 inches to 4 inches, or from 0.5 inches to 2 inches. For example, the tube may have a length substantially equal to the length of a standard firearm casing body, optionally including the length of the neck portion of the casing.

In an embodiment, a gas container is integral with the tube. In an embodiment, the gas container and the tube form a unitary body. In another embodiment, the gas container is separate from the tube. In an embodiment, the gas container is press fit into the tube.

In an embodiment, the tube comprises a threaded portion. In an embodiment, the threaded portion comprises a hollow center for receiving at least a portion of a puncturing device. In an embodiment, a tube comprises a threaded portion having a smaller outer diameter than the tube.

In an embodiment, the tube comprises recesses for mating with a manufacturing tool.

In an embodiment, the gas container is made of a material selected from a metal, a metal alloy, a plastic, an elastomer, wood, cardboard, carbon fiber and combinations thereof. In an embodiment, a gas container is press fit into the tube.

In an embodiment, the gas container is flat or tapered to a truncated point at a first end of the gas container, a second end of the gas container or both a first end and a second end of the gas container.

In an embodiment, a gas container has a diameter selected from 2.54 mm to 3.048 meters, or from 2.54 mm to 1 meter, or from 2.54 mm to 25 centimeters, or from 4 mm to 1 meter, or from 4 mm to 0.5 meters, or from 4 mm to 25 centimeters, or from 5 mm to 10 centimeters, or from 10 mm to 50 mm. In an embodiment, a gas container has a length selected from 25 mm to 2.5 meters, or from 25 mm to 1 meter, or from 25 mm to 0.5 meters, or from 25 mm to 25 cm, or from 25 mm to 10 cm, or from 27 mm to 50 mm.

Typically, the gas container comprises a gas at a pressure greater than or equal to 750 psi and the gas is any non-flammable, non-combustible gas. In an embodiment, the gas may be selected from the group consisting of carbon dioxide, nitrogen, air, helium, neon, argon, xenon and combinations thereof.

In an embodiment, the gas container is maintained in position by frictional contact with the tube. In an embodiment, the gas container is maintained in position by a retaining feature(s) on one or both sides of the gas container. For example, retaining features may be selected from the group consisting of indentations of the tube wall, tabs, a collar, O-rings, welding joints, sealants, adhesives and combinations thereof.

In an embodiment, a propulsion system is at least partially disposed within a casing. In an embodiment, a propulsion system is completely disposed within a casing. In an embodiment, a propulsion system is integral with a casing. In an embodiment, a tube of a propulsion system and a casing form a unitary body. In an embodiment, a tube of a propulsion system extends outside of a casing. For example, a tube of a propulsion system may replace a neck of a necked casing.

In an embodiment, a casing is a firearm casing selected from a necked casing, a shotgun shell casing, a missile casing, a cannon casing or an artillery casing. In an embodiment, a casing is made of brass, steel, plastic, wood, cardboard, carbon fiber or a combination thereof.

In an embodiment, a propulsion system further comprises a groove for receiving a locking device that secures the propulsion system within a casing.

In an embodiment, a casing comprises a threaded hole in its base.

In an embodiment, a portion of a propulsion system or tube is threaded and securable to a threaded portion of a casing. For example, a casing may be threaded at a central portion of its base, where a primer might otherwise be located.

In an embodiment, a propulsion system further comprises a projectile mounted in or on the end region of the tube. For example, the projectile may be frictionally mounted in or on the end region of the tube.

In an embodiment, the projectile is a cleaning projectile. In an embodiment, the projectile comprises a mechanical cleaner and/or a chemical. In an embodiment, the projectile comprises a mechanical cleaner selected from the group consisting of a wire, an abrasive pad, a scour pad, a brush, a cloth, a sponge, a wire mesh, a wire brush, feathers and combinations thereof. In an embodiment, the projectile comprises a chemical selected from the group consisting of a detergent, a lubricant, an etchant, a wax, a sealant, a drying agent, an oil, a solvent, a conditioning agent and combinations thereof.

In an embodiment, the projectile is biodegradable.

In an aspect, a firearm barrel cleaner comprises a propulsion system disposed within a firearm casing such that an annular space exists between an outer wall of the tube and an inner wall of the casing, wherein the casing comprises a puncturing device disposed between the casing and the gas container, the puncturing device being actuated when a firing pin of the firearm is triggered. In an embodiment, a firearm barrel cleaner comprising a propulsion system and a puncturing device, but no projectile, may be used to force air through the barrel of a firearm, thereby cleaning and/or drying the firearm. In an embodiment, a firearm barrel cleaner may be used with or without a projectile.

In an aspect, a firearm barrel cleaner comprises a propulsion system disposed within a firearm casing such that an annular space exists between an outer wall of the tube and an inner wall of the casing and a projectile mounted in or on the propulsion system or the casing, wherein the casing comprises a puncturing device disposed between a bottom of the casing or a strike plate of the casing and the gas container, the puncturing device being actuated when a firing pin of the firearm is triggered.

In an embodiment, the annular space between the outer wall of the tube and the inner wall of the casing is between 0.1 inches and 24 inches, or between 0.1 inches and 12 inches, or between 0.1 inches and 6 inches, or between 0.1 inches and 1 inch, or between 0.1 inches and 0.5 inches, or between 0.1 inches and 0.25 inches. In an embodiment, the annular space between the outer wall of the tube and the inner wall of the casing is less than 1 inch, or less than 0.5 inches, or less than 0.25 inches, or less than 0.125 inches.

In an embodiment, a firearm barrel cleaner further comprises a gas-tight seal between the propulsion system and a neck of the firearm casing.

In an aspect, a method for making a propulsion system, comprises: providing a tube having a first retaining feature near a first end region of the tube; inserting a gas container into a second end region of the tube until the gas container abuts the first retaining feature; forming a second retaining feature near the second end region of the tube and abutting the gas container; wherein the gas container is disposed at a mid-section of the tube; and providing at least one vent in the first end region of the tube, the second end region of the tube or both the first end region and the second end region of the tube.

In an aspect, a method of making a firearm barrel cleaner comprises: providing a firearm casing comprising a puncturing device; mounting a projectile in or on a propulsion system; and inserting the propulsion system in the firearm casing such that the puncturing device is aligned with the gas container.

In an embodiment, a method of making a firearm barrel cleaner further comprises securing the propulsion system within the firearm casing by joining a locking device in the firearm casing with a groove formed in the tube of the propulsion system. In an embodiment, a method of making a firearm barrel cleaner further comprises securing the propulsion system within the firearm casing by joining a threaded portion of the firearm casing with a threaded portion of the tube of the propulsion system.

In an aspect, a method of using a firearm barrel cleaner comprises: providing a firearm barrel cleaner; loading the firearm barrel cleaner in the ammunition chamber of a firearm; and pulling the trigger of the firearm to actuate the puncturing device of the firearm barrel cleaner, thereby releasing pressurized gas that propels the projectile along a barrel of the firearm.

In an aspect, a propulsion system comprises a tube comprising a gas container disposed at a mid-section of the tube; the gas container maintained in position by retaining features on both sides of the gas container; and first and second end regions of the tube extending beyond the retaining features; wherein the tube comprises at least one vent in the first end region of the tube, the second end region of the tube, or both the first end region of the tube and the second end region of the tube.

In an aspect, a puncturing device comprises: a ramrod having a proximal end and a distal end, the distal end comprising a pointed head; and a spring encircling a portion of the ramrod between the proximal end and the distal end, the spring disposed between a spring stop on the ramrod nearer the distal end and a breakaway component nearer the proximal end.

In an aspect, a firearm casing outfitted with a puncturing device comprises: a ramrod extending through a primer hole of a firearm casing, a proximal end of the ramrod abutting a strike plate of the firearm casing and a distal end of the ramrod comprising a pointed head; a spring encircling a portion of the ramrod between a top of the primer hole and a spring stop on the ramrod; and a breakaway component disposed against a bottom of the primer hole; wherein the breakaway component maintains the spring under tension until the breakaway component is broken by force applied to the ramrod through the strike plate.

In an aspect, a puncturing device comprises: a ramrod having a proximal end and a distal end, the distal end comprising a pointed head, the proximal end extending at least partially through a primer hole of a casing. For example, the proximal end of the ramrod may extend through the inner circumference of a tube of a propulsion system threaded into a threaded primer hole. In an embodiment, a ramrod comprises a sabot.

In an embodiment, a puncturing device does not comprise a spring. In an embodiment, a puncturing device that does not comprise a spring includes a breakaway component.

In an aspect, a firearm casing outfitted with a puncturing device, propulsion system and projectile comprises: a ramrod extending through a primer hole of a firearm casing, a proximal end of the ramrod abutting a strike plate of the firearm casing and a distal end of the ramrod comprising a pointed head; a spring encircling a portion of the ramrod between a top of the primer hole and a spring stop on the ramrod; a breakaway component disposed against a bottom of the primer hole; a propulsion system comprising: a tube at least partially housing a gas container; and at least one end region of the tube extending beyond the gas container; wherein the tube comprises at least one vent in the at least one end region; the propulsion system disposed within the firearm casing such that an annular space exists between an outer wall of the tube and an inner wall of the casing; and a projectile mounted in or on the end region of the tube.

In an embodiment, a firearm casing outfitted with a puncturing device, propulsion system and projectile further comprises a flexible gas-tight seal around the ramrod and the primer hole.

In an embodiment, the pointed head comprises one or more channels radiating from a tip of the pointed head.

In an embodiment, the breakaway component is selected from the group consisting of a bar extending through the ramrod, a clamp at least partially surrounding the ramrod, mated male and female components connected to the ramrod—such as a hook-and-eye, a ball-and-socket or a substantially linear receptor and insert—or a combination thereof. In an embodiment, a clamp at least partially surrounding a ramrod may interface with a groove in the ramrod. In an embodiment, the breakaway component is perforated. In an embodiment, the breakaway component interfaces with a strike plate of a firearm casing.

In an aspect, a method of outfitting a firearm casing with a puncturing device comprises: providing a pointed head on a distal end of a ramrod; sliding a spring onto the ramrod between a proximal end of the ramrod and a spring stop; extending the proximal end of the ramrod through a primer hole of a firearm casing until the proximal end abuts a strike plate of the firearm casing, thereby tensioning the spring between the top of the primer hole and the spring stop; and securing the ramrod with the spring under tension by providing a breakaway component against a bottom of the primer hole.

In an aspect, a method of using a puncturing device to launch a projectile from a firearm casing comprises: outfitting a firearm casing with a puncturing device; mounting a projectile in or on a propulsion system comprising: a tube at least partially housing a gas container; and at least one end region of the tube extending beyond the gas container; wherein the tube comprises at least one vent in the at least one end region; inserting the propulsion system in the firearm casing such that the puncturing device is aligned with the gas container; loading the firearm casing containing the propulsion system and the projectile in the ammunition chamber of a firearm; and pulling the trigger of the firearm to actuate a firing pin that strikes the strike plate and moves the ramrod, thereby fracturing the breakaway component and releasing the tension of the spring, which allows the pointed head to puncture the gas container, thereby releasing pressurized gas that propels the projectile along a barrel of the firearm.

In an aspect, a gas container comprises a cylindrical tube comprising a rounded, sealed end and an opposing, open end, where an internal wall of the cylindrical tube comprises an internal flange. A base configured to abut the internal flange and substantially seal the open end of the cylindrical tube forms part of the gas container. An outer diameter of the gas container at the open end is substantially equal to an outer diameter of the cylindrical tube at its mid-point.

In an embodiment, an outer diameter of the base is substantially equal to an inner diameter of the gas container at the open end.

In an embodiment, the base comprises a raised edge for abutting the internal flange. In an embodiment, the raised edge has a width substantially equal to a width of the internal flange.

In an embodiment, the base is substantially planar. For example, the base may comprise a substantially planar puncture plate.

In an embodiment, the base is removable from the cylindrical tube, thereby allowing the cylindrical tube to be reused. For example, although the base may be permanently welded, press fit, or mechanically joined to the cylindrical tube, the base may alternatively be removably attached to the cylindrical tube, such as by threads on an outer edge of the base that mate with threads near the internal flange of the cylindrical tube.

In an embodiment, an exterior wall of the cylindrical tube extends beyond the internal flange, the exterior wall forming a collar and comprising at least one vent.

In an embodiment, the base is physically separated from an outer edge of the collar.

In an embodiment, the exterior wall of the cylindrical tube extends beyond the rounded, sealed end to form a second collar, which optionally comprises at least one vent.

In an embodiment, an exterior wall of the cylindrical tube extends beyond the rounded, sealed end, the exterior wall forming a collar and comprising at least one vent.

In an embodiment, the gas container is disposed at least partially within a casing.

In an embodiment, a puncturing device is disposed within an exterior wall of the cylindrical tube that extends beyond the internal flange and the exterior wall comprises at least one vent.

In an embodiment, a puncturing device comprises a pointed head, which optionally comprises one or more channels radiating from a tip of the pointed head.

In an embodiment, a puncturing device comprises a pointed head, a sabot, and a ramrod that extends at least partially through a primer hole of a casing.

In an embodiment, a gas container further comprises a projectile mounted in or on an exterior wall of the cylindrical tube, the exterior wall extending beyond the rounded, sealed end of the cylindrical tube and comprising at least one vent.

In an embodiment, components of the devices described herein may be joined together by friction, adhesive, metal welding, ultrasonic welding, thermal welding, mechanical fasteners and combinations thereof.

DETAILED DESCRIPTION

Figure 1B:
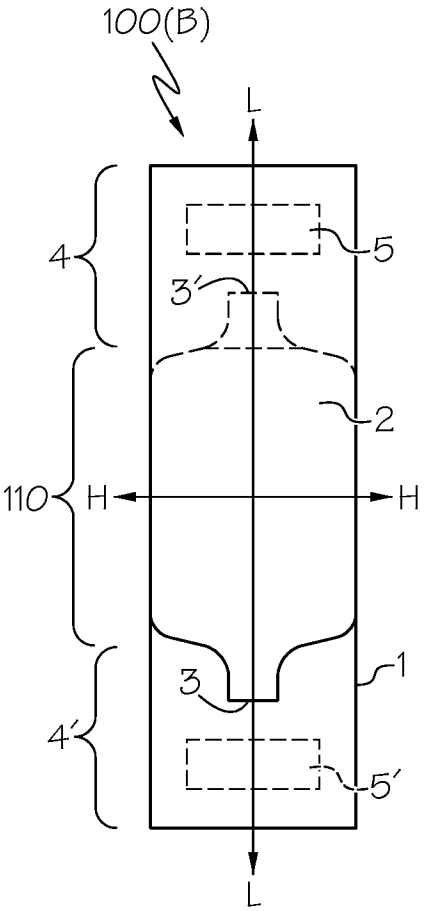
FIGS. 1A and 1B show cross-sectional schematics of propulsion systems, according to multiple exemplary embodiments.

In general, the terms and phrases used herein have their art-recognized meaning, which can be found by reference to standard texts, journal references and contexts known to those skilled in the art. The following definitions are provided to clarify their specific use in the context of this description.

A "device" is a combination of components operably connected to produce one or more desired functions.

A "component" is used broadly to refer to an individual part of a device.

The terms "direct and indirect" describe the actions or physical positions of one component relative to another component, or one device relative to another device. For example, a component that "directly" acts upon or touches another component does so without intervention from an intermediary. Contrarily, a component that "indirectly" acts upon or touches another component does so through an intermediary (e.g., a third component).

As used herein, a longitudinal dimension is the longest dimension of a device or component, and a horizontal dimension is perpendicular to the longitudinal dimension.

"Integral" refers to items or components that are unitary in structure. For example, unitary items or components may be formed as a single structure or unitary body. Items or components that are not integral or unitary form at least two distinct structures that are separate or easily separated from one another.

A "casing" may include any suitable container having a cavity for at least partially enclosing, storing and/or confining a propulsion system of the present invention. Casings disclosed herein are typically cylindrical or tubular in form.

As used herein, the term "necked casing" refers to a casing having a body of one size or diameter connected to a collar or neck of a smaller size or diameter. In contrast, opposing walls of a "straight-walled casing" are substantially parallel to one another such that a straight-walled casing has a substantially uniform or consistent size or diameter.

A "puncturing device" broadly refers to a mechanical tool or system aligned and adapted to pierce a surface upon actuation by a trigger.

"Elastomer" refers to a polymeric material that can be stretched or deformed and returned to its original shape without substantial permanent deformation. Elastomers commonly undergo substantially elastic deformations. Useful elastomers include those comprising polymers, copolymers, composite materials or mixtures of polymers and copolymers. Useful elastomers include, but are not limited to, thermoplastic elastomers, styrenic materials, olefinic materials, polyolefin, polyurethane thermoplastic elastomers, polyamides, synthetic rubbers, polybutadiene, polyisobutylene, poly(styrene-butadiene-styrene), polyurethanes, polychloroprene and silicones. Exemplary elastomers include, but are not limited to silicon containing polymers such as polysiloxanes including poly(dimethyl siloxane) (i.e. PDMS and h-PDMS), poly(methyl siloxane), partially alkylated poly(methyl siloxane), poly(alkyl methyl siloxane) and poly(phenyl methyl siloxane), silicon modified elastomers, thermoplastic elastomers, styrenic materials, olefinic materials, polyolefin, polyurethane thermoplastic elastomers, polyamides, synthetic rubbers, polyisobutylene, poly(styrene-butadiene-styrene), polyurethanes, polychloroprene and silicones.

Figure 1A:
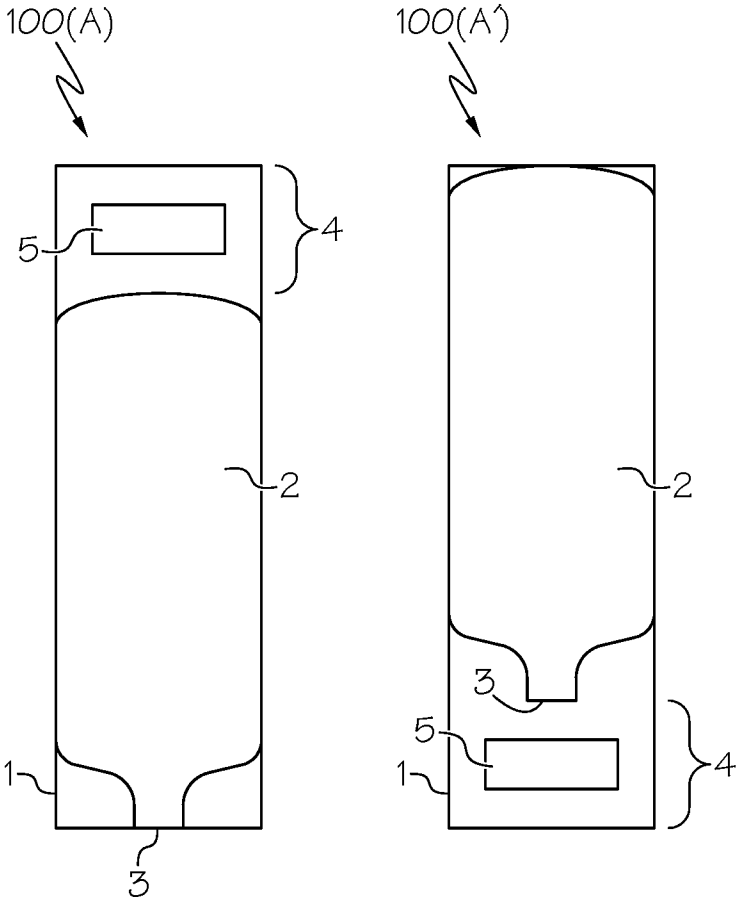

FIG. 1 shows cross-sectional schematics of propulsion systems 100 according to multiple embodiments. FIG. 1A shows propulsion systems 100(A) and 100(A') comprising a tube 1 housing a gas container 2. Tube 1 has at least one end region 4 extending beyond gas container 2. In propulsion system 100(A), end region 4 is distal to a portion of gas container 2 that is configured to be punctured. In propulsion system 100(A'), end region 4 is proximal to a portion of gas container 2 that is configured to be punctured. In either configuration, tube 1 comprises at least one vent 5 in end region 4. As shown, gas container 2 is tapered to a truncated point 3 on only one end. FIG. 1B shows another propulsion system 100(B) with a gas container 2, optionally comprising truncated points on both ends, disposed at a mid-section 110 of tube 1 such that the tube comprises a second end region 4'. Optionally, tube 1 comprises at least one vent 5' in the second end region 4' of the tube. The embodiment shown in FIG. 1B may be symmetrical across both a central horizontal plane (H-H) and a central longitudinal plane (L-L) of the propulsion system. A symmetrical propulsion system may be used in either an upright or inverted orientation, thereby expediting the assembly of devices using the propulsion system.

Figure 2B:
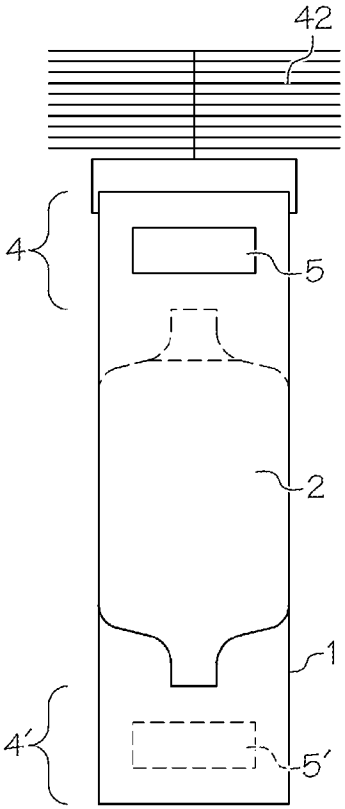
FIGS. 2A and 2B show propulsion systems mounted with various projectiles, according to multiple exemplary embodiments.
Figure 2A:
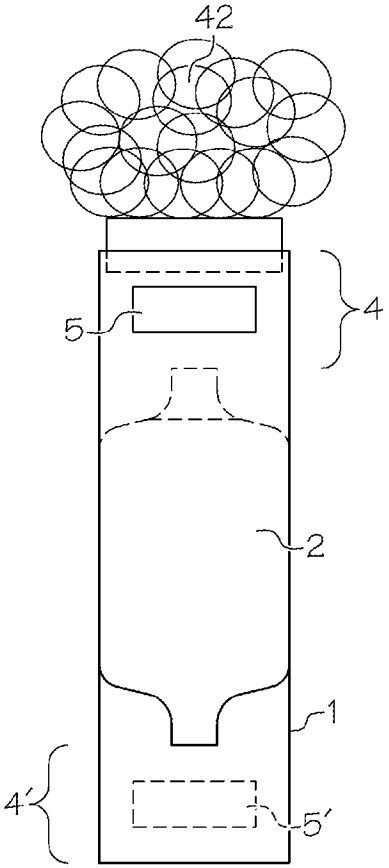

FIG. 2 shows propulsion systems 100 mounted with various projectiles 42 according to multiple embodiments. FIG. 2A illustrates a projectile 42 mounted inside the end region 4 of tube 1, whereas FIG. 2B illustrates a projectile 42 mounted on the outside of end region 4. Either mounting method may be used with various types of projectiles including, but not limited to, a cloth wad, wire mesh (see FIG. 2A) or brush (see FIG. 2B).

Figure 3:
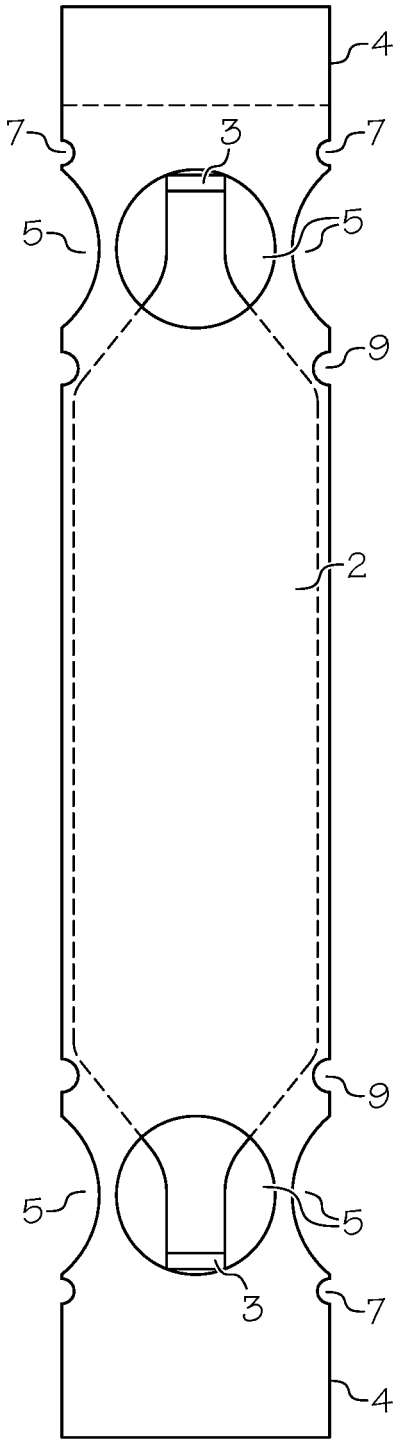
FIG. 3 is a schematic of a propulsion system including retaining features and grooves, according to an embodiment.

FIG. 3 is a schematic of a propulsion system 100 that includes retaining features 9 for maintaining the position of gas container 2 inside tube 1 and grooves 7 for interfacing with a locking mechanism inside a casing. The propulsion system of FIG. 3 is symmetrical across both a central horizontal plane (H-H) and a central longitudinal plane (L-L) of the propulsion system, which expedites the assembly of devices using the propulsion system.

Figure 4:
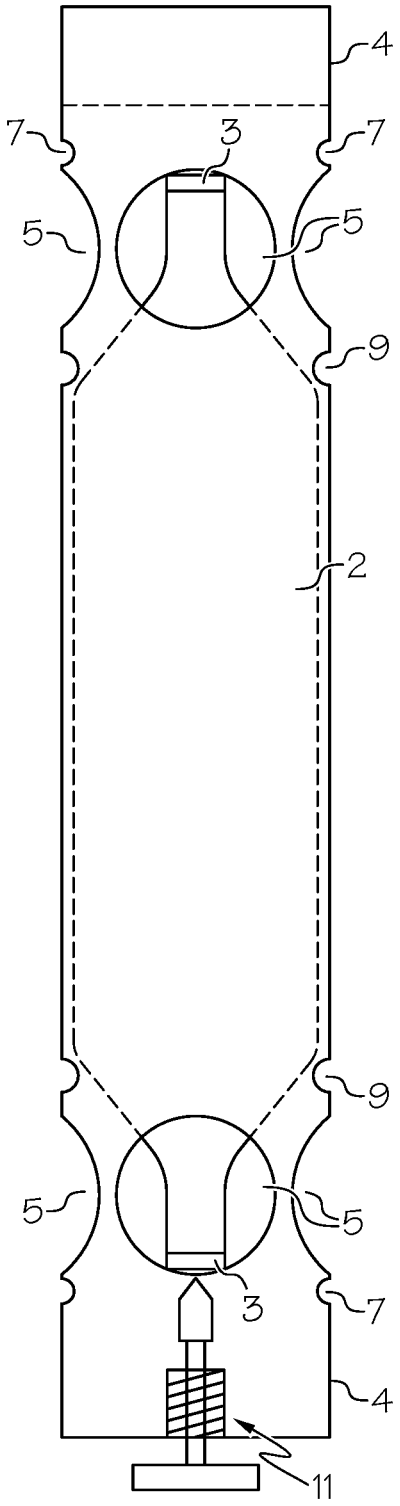
FIG. 4 shows the propulsion system of FIG. 3 aligned with a puncturing device, according to an embodiment.

FIG. 4 shows the propulsion system of FIG. 3 where the truncated point 3 of gas container 2 is aligned with a puncturing device 11 (described in greater detail in connection with FIG. 5).

Figure 5:
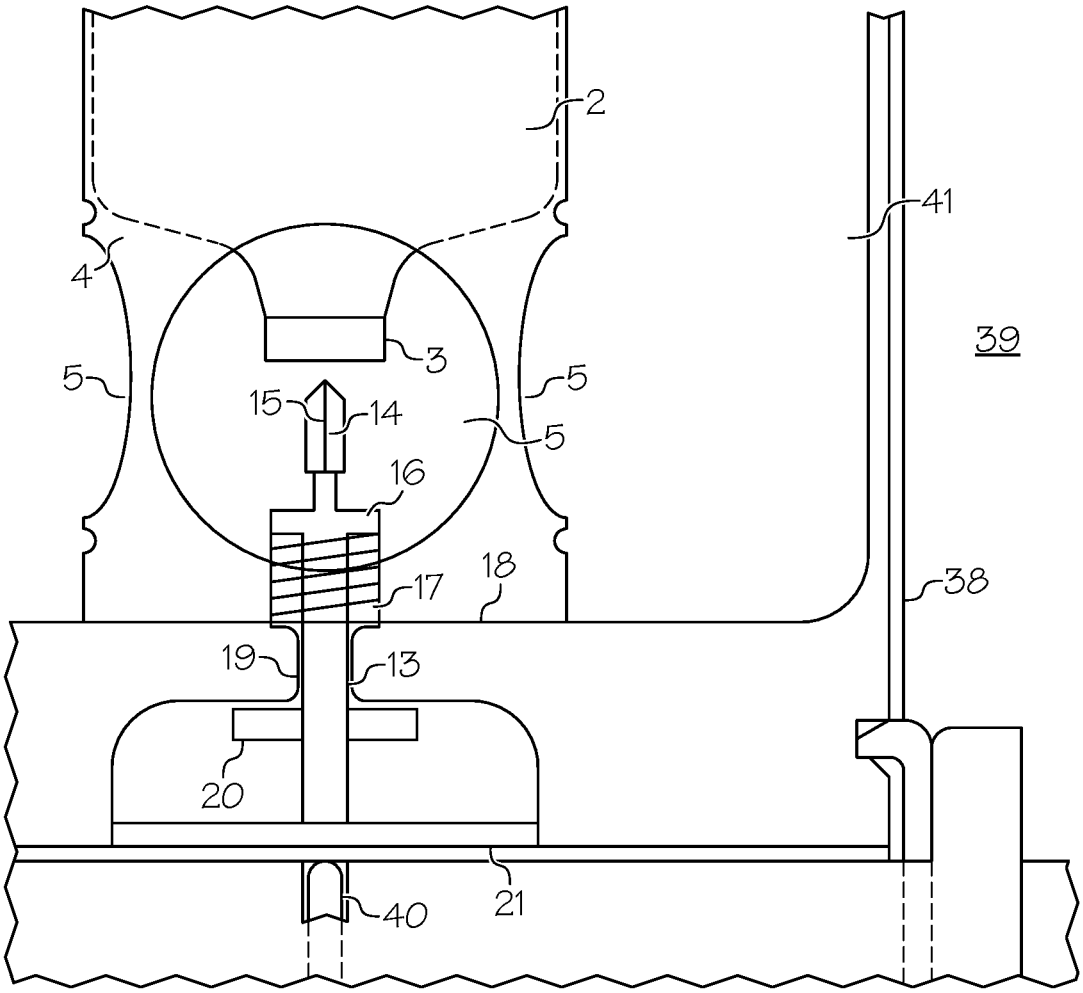
FIG. 5 is a partial view of a firearm casing outfitted with a puncturing device and a propulsion system, according to an embodiment.

FIG. 5 is a partial view of a firearm casing 38 outfitted with a puncturing device 11 and a propulsion system 100. As shown, firearm casing 38 is in the chamber of a firearm 39. Puncturing device 11 includes a ramrod 13 with a pointed head 14 and a spring 17 encircling a portion of ramrod 13. Ramrod 13 extends through a primer hole 19 of firearm casing 38 until its proximal end abuts a strike plate 21. Spring 17 is disposed between a spring stop 16 on ramrod 13 and a top of primer hole 19. A breakaway component 20 is disposed against a bottom of primer hole 19. Breakaway component 20 maintains spring 17 under tension until the breakaway component is broken by force applied to ramrod 13 through the action of a firing pin 40 on strike plate 21. Once spring 17 is untensioned, pointed head 14 pierces gas container 2 releasing pressurized gas, which escapes through vents 5' in tube 1 into an annular space 41 between an outer wall of tube 1 and an inner wall of firearm casing 38. The pressurized gas then re-enters tube 1 through vents 5 near a projectile 42 mounted in or on the top end region 4, and the build up of sufficient pressure propels projectile 42 along the barrel of firearm 39 until it exits the muzzle. In some embodiments, a flexible gas-tight seal 18 is disposed around ramrod 13 and primer hole 19 to prevent gas leakage into the primer compartment.

Pointed head 14 may include one or more channels 15 radiating from a tip of the pointed head. Channels 15 allow the pressurized gas to escape gas container 2 even if pointed head 14 fails to retract after puncturing gas container 2.

Figure 6:
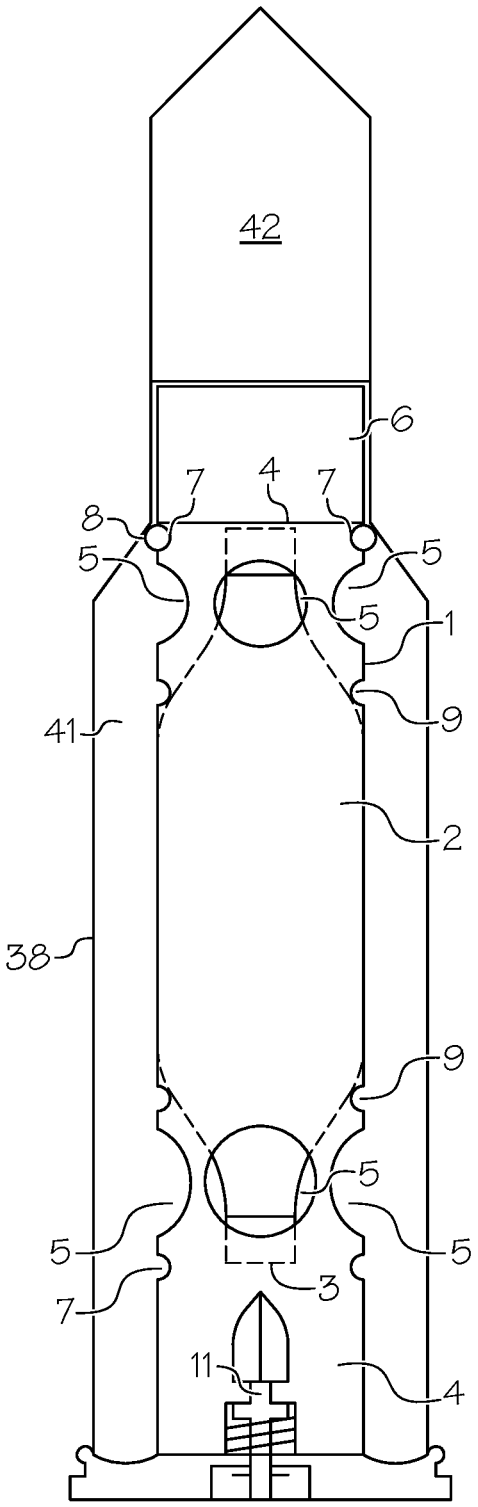
FIG. 6 is a schematic of a necked firearm casing outfitted with a puncturing device, a propulsion system and a projectile, according to an embodiment.

FIG. 6 is a schematic of a necked firearm casing 38 outfitted with a puncturing device 11, a propulsion system 100 and a projectile 42. A gas-tight gasket or seal 8 may prevent gas escape between tube 1 and the inner wall of casing 38.

Figure 7:
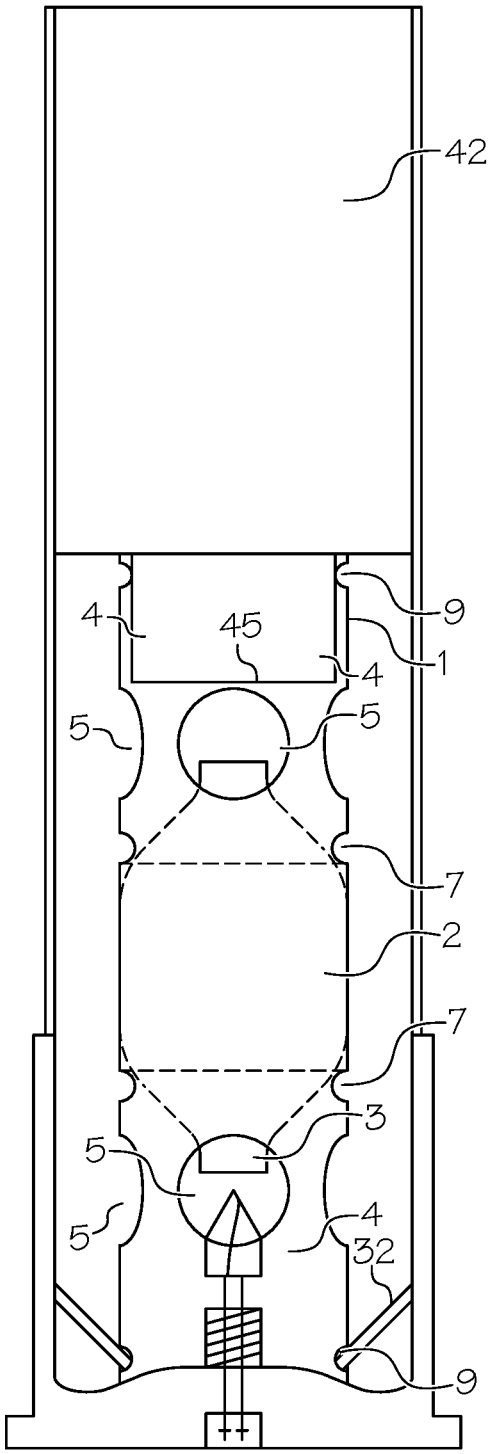
FIG. 7 is a schematic of a straight-walled firearm casing outfitted with a puncturing device, a propulsion system and a projectile, according to an embodiment.

FIG. 7 is a schematic of a straight-walled firearm casing 34, such as a shotgun shell, outfitted with a puncturing device 11, a propulsion system 100 and a projectile 42, Projectile 42 includes a base 45 for mounting the projectile in or on end region 4 of propulsion system 100, which is secured within casing 34 by locking device 32. Suitable locking devices 32 include, but are not limited to, a plurality of rigid arms, a locking ring, or any other unidirectional mechanical device.

Figure 8:
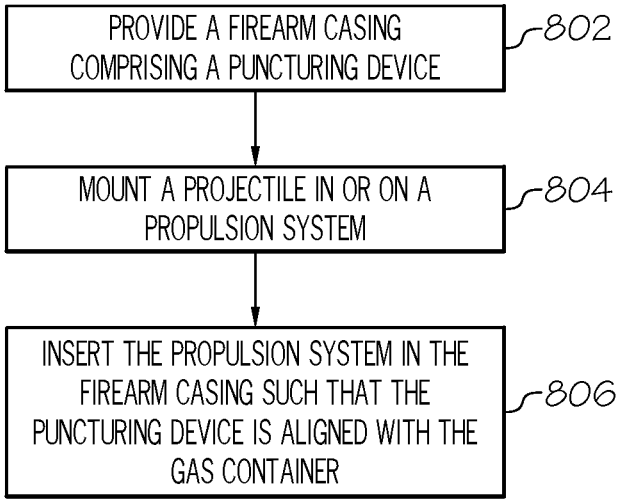
FIG. 8 shows a flow diagram for making a firearm barrel cleaner, according to an embodiment.

FIG. 8 shows a flow diagram for making a firearm barrel cleaner. In step 802, a firearm casing 34,38 comprising a puncturing device 11 is provided. In step 804, a projectile 42 is mounted in or on a propulsion system 100. In step 806, the propulsion system 100 is inserted in the firearm casing 34,38 such that the puncturing device 11 is aligned with the gas container 2 of the propulsion system 100. Those of skill in the art will appreciate that these steps may be performed in an order other than what is outlined above. For example, the propulsion system 100 may be inserted into the firearm casing (step 806) before or after the projectile is mounted to the propulsion system (step 804).

Figure 9:
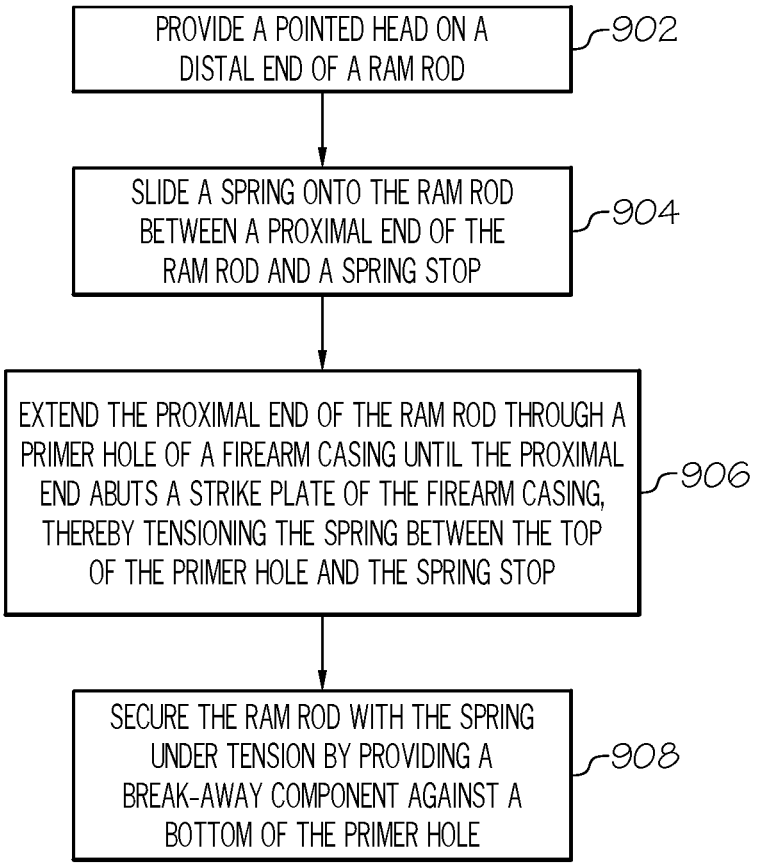
FIG. 9 shows a flow diagram for outfitting a firearm casing with a puncturing device, according to an embodiment.
Figure 10A:
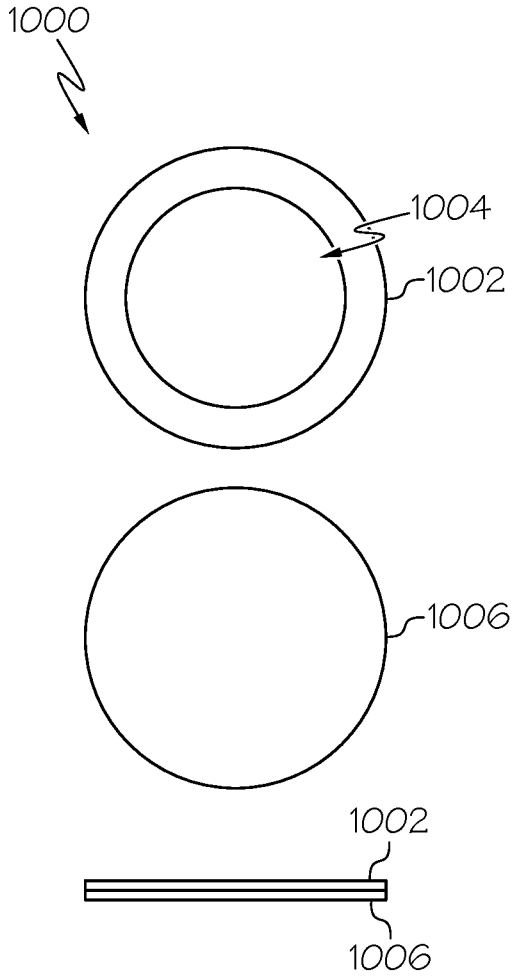
FIGS. 10A, 10B, 10C and 10D illustrate the stepwise fabrication of a flat-based gas container integrally formed with a tube having end regions and vents for possible incorporation into a firearm barrel cleaner, according to an embodiment.
Figure 10B:
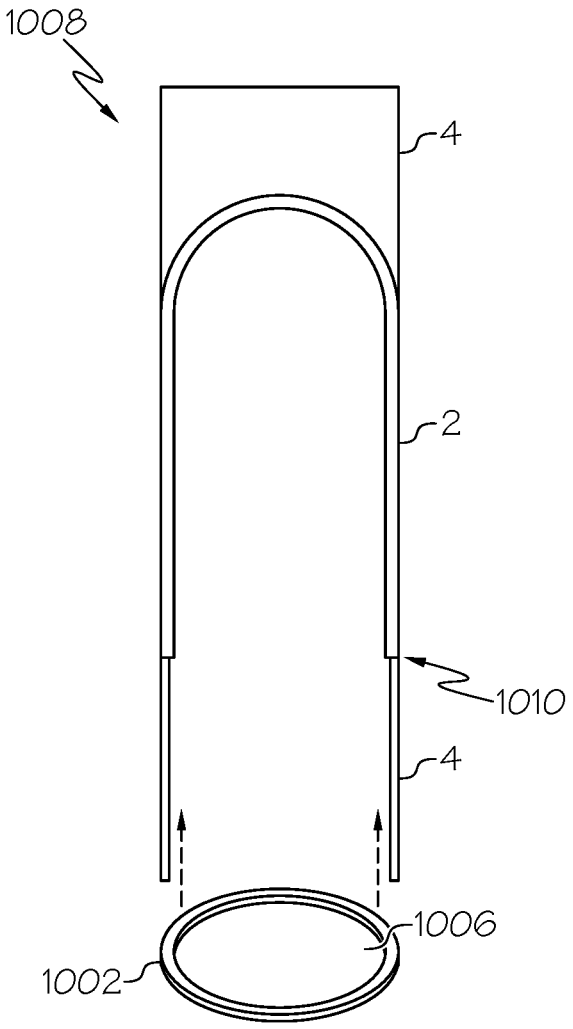
Figure 10C:
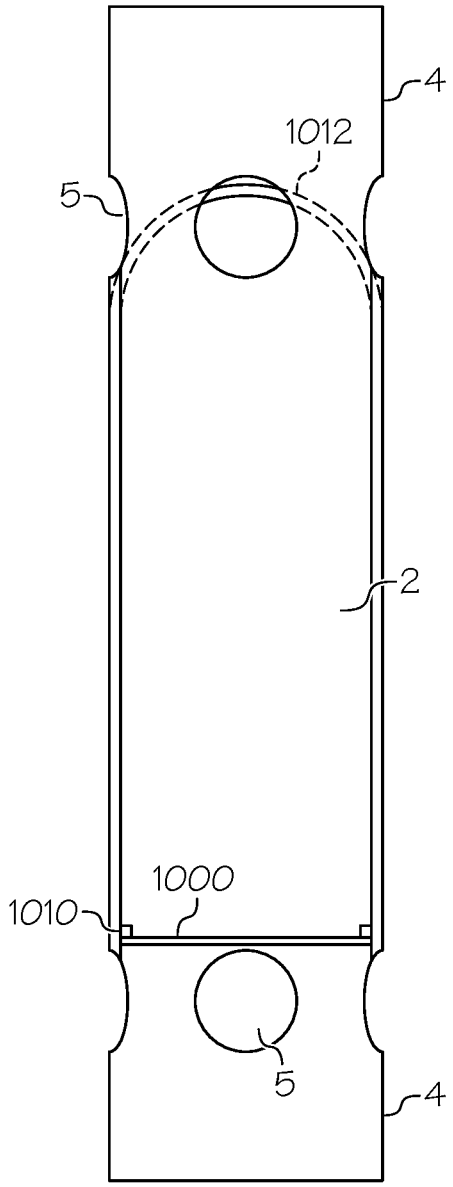
Figure 10D:
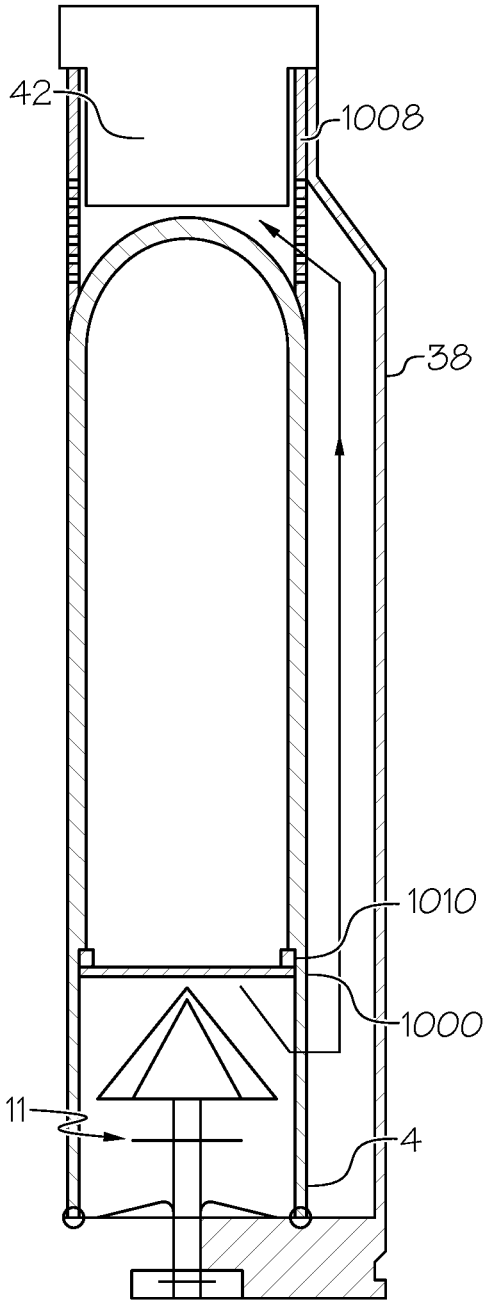

FIG. 9 shows a flow diagram for outfitting a firearm casing 34,38 with a puncturing device 11. In step 902 a pointed head 14 is provided on a distal end of a ramrod 13 comprising a spring stop 16. A spring 17 is then slid onto the ramrod 13 between a proximal end of the ramrod and the spring stop 16, in step 904. The proximal end of the ramrod is then extended through a primer hole 19 of a firearm casing 34,38 until the proximal end abuts a strike plate 21 of the firearm casing 34,38, thereby tensioning the spring 17 between the top of the primer hole 19 and the spring stop 16 (step 906). In step 908, the ramrod 13 is secured with the spring 17 under tension by providing a breakaway component 20 against a bottom of the primer hole 19.

FIG. 10 illustrates the stepwise fabrication of a flat-based gas container. As shown in FIG. 10A, the flat base 1000 includes a hollow frame 1002 having an opening 1004 in a center of the frame and a puncture plate 1006. Hollow frame 1002 and puncture plate 1006 interface in a substantially coplanar orientation, as shown in the side view of FIG. 10A. Flat-based gas containers may be formed as individual components, or as integral components of a unitary body 1008 comprising at least one tubular end region/collar 4 and a gas container 2. As shown in FIG. 10B, unitary body 1008 comprises a step feature/internal flange 1010 against which flat base 1000 may be seated and sealed. Vents 5 may be formed in end regions/collars 4 before or after flat base 1000 is inserted into the tube (FIG. 10C). In some embodiments, a top portion 1012 of gas container 2 extends longitudinally as far or farther than vents 5 without impeding gas flow, which allows for a greater gas container volume and higher gas pressure within the space of the tube. FIG. 10D shows a partial cross-sectional view of the propulsion system of FIG. 10C incorporated into a firearm barrel cleaner, where only the right side of the casing and gas flow through the annular space is shown.

Figure 11A:
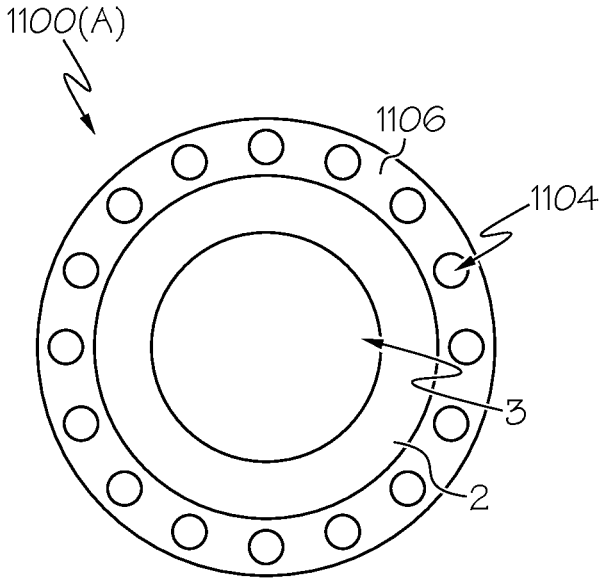
FIGS. 11A, 11B and 11C show a gasket, with fully or partially formed passages, for aligning a gas container with a puncturing device within a casing, according to an embodiment.
Figure 11B:
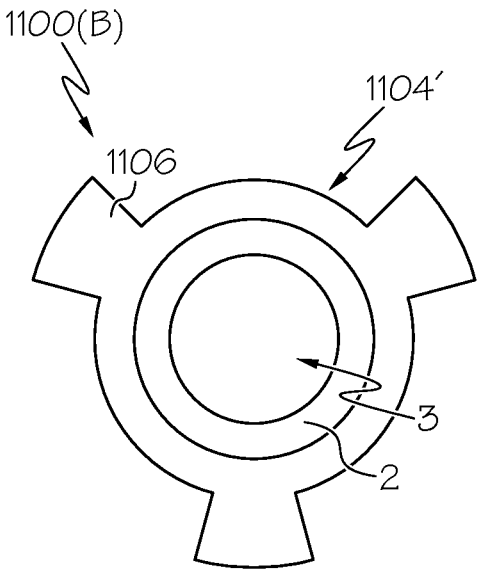
Figure 11C:
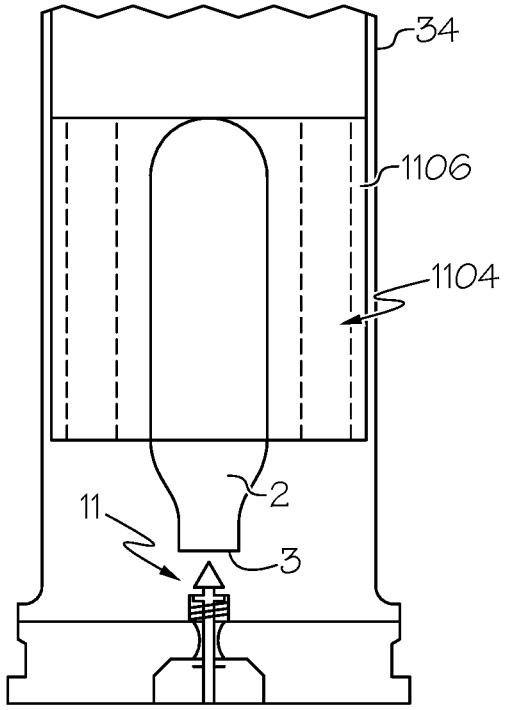
Figure 12B:
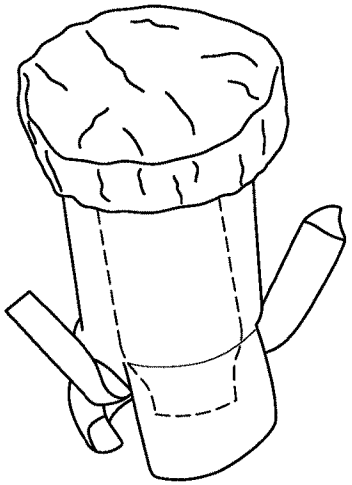
FIGS. 12A, 12B, 12C and 12D show schematics of propulsion systems, according to multiple exemplary embodiments.
Figure 12D:
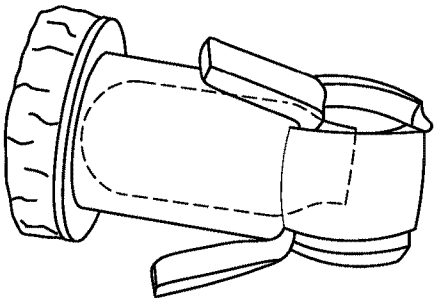
Figure 12A:
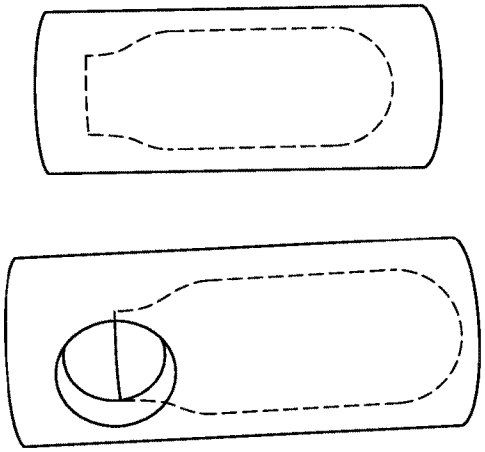
Figure 12C:
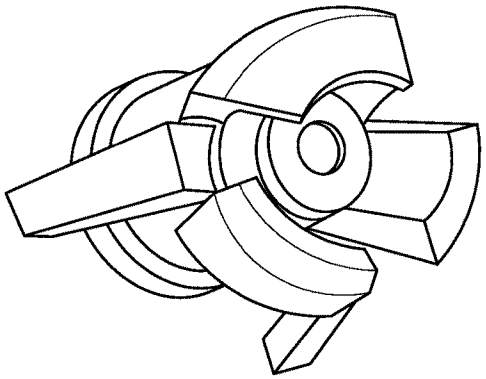

FIG. 11 shows bottom end views of gaskets 1100(A) and 1100(B). As shown, the gaskets at least partially encapsulate gas containers 2 that are tapered to truncated points 3. However, flat-bottom gas containers (FIG. 10) may be used instead of the pointed gas containers shown. Either type of gas container is held frictionally within the gasket, which may for example be made of plastic, rubber or another elastomer. The outer circumferences of gaskets 1100 include solid portions 1106 and fully formed passages 1104 or partially formed passages 1104'. When a gasket 1100 encapsulating a gas container 2 is positioned within a casing, such as a straight-walled casing 34, gas container 1 is aligned with a puncturing device 11 and passages 1104, 1104' allow for gas flow from a bottom portion of the casing toward a top portion of the casing. A projectile is optionally disposed near a top of the casing.

FIG. 12 shows schematics of propulsion systems, according to multiple exemplary embodiments. As shown in FIG. 12A, a gas container is inserted in a plastic tube and vents are provided in at least one end region of the tube. FIG. 12B shows another embodiment of a propulsion system where vents are cut as slits in at least one end region of the tube, and optionally the material of the slits is raised or bent to form one or more legs or braces that may be used to secure the propulsion system within a casing. As shown, the propulsion system also includes a projectile, such as a cleaning projectile disposed in or on an end region of the tube. In some embodiments, a projectile may serve as a compression seal that allows for the build-up of gas pressure. FIG. 12C shows the bottom of the propulsion system of FIG. 12B. FIG. 12D shows a side perspective view of the propulsion system of FIGS. 12B and 12C.

Figure 13A:
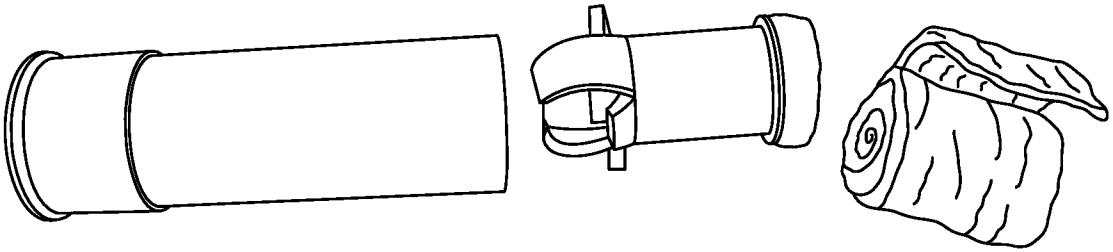
FIGS. 13A and 13B show schematics of an unassembled pneumatic firearm barrel cleaner and an assembled pneumatic firearm barrel cleaner, according to an embodiment.
Figure 13B:
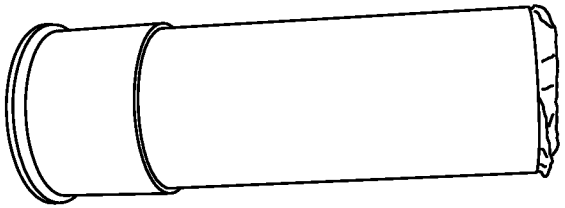

FIG. 13A shows a schematic of an unassembled pneumatic firearm barrel cleaner comprising a casing, such as a shotgun casing, a propulsion system and two projectiles, including one projectile (attached to the propulsion system) that acts as a compression seal for gas within the annular space between the propulsion system and the casing. FIG. 13B shows a schematic of the pneumatic firearm barrel cleaner of FIG. 13B in a fully assembled state.

Figure 14:
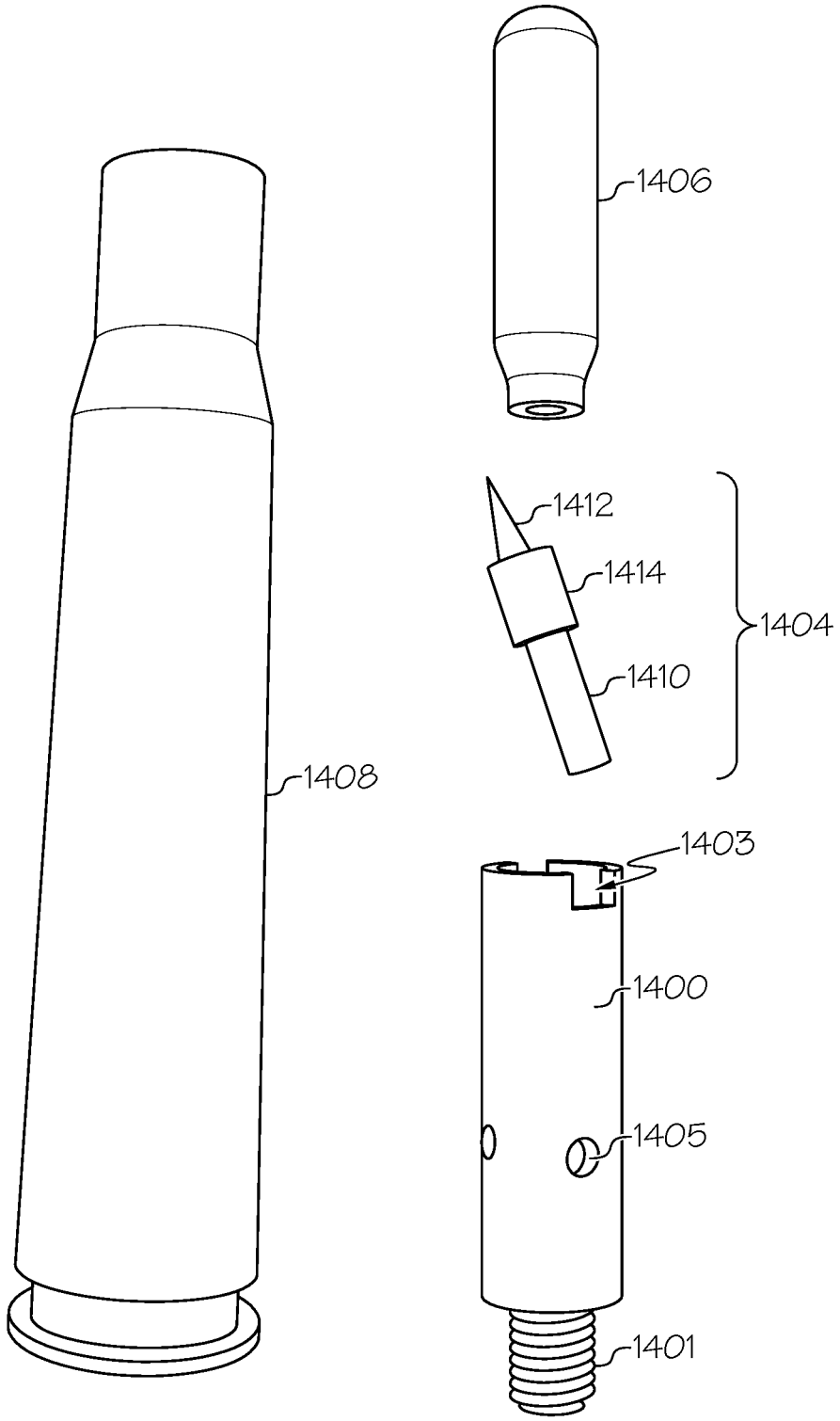
FIG. 14 shows a schematic of an unassembled propulsion system, puncturing device and casing, according to an embodiment.

FIG. 14 shows a schematic of an unassembled propulsion system (tube 1400 and gas container 1406), puncturing device 1404, and casing 1408, according to an embodiment. Tube 1400 comprises a threaded portion 1401, one or more vents 1405, and recesses 1403 for mating with a manufacturing tool that screws tube 1400 into a threaded base of casing 1408. Optionally, the same manufacturing tool may be used to press fit gas container 1406 in tube 1400. The press fit of these components retains gas container 1406 in tube 1400 against the pressure of escaping gas after gas container 1406 has been punctured. Puncturing device 1404 includes a ramrod 1410 at a proximal end, a pointed head 1412 at a distal end, and a sabot 1414 between the ends. In an embodiment, a shelf within the cavity of tube 1404 abuts the bottom edge of sabot 1414 to position puncturing device 1404. Ramrod 1410 of puncturing device 1404 is typically disposed within a hollow portion of the threaded portion 1401 of tube 1400, where it is accessible to and actuated by a firing pin of a firearm. The force transferred to puncturing device 1404 by the firing pin is used to pierce gas container 1406. The compressed gas within the container then escapes through vent(s) 1405 into an annular space between tube 1400 and casing 1408. With sufficient pressure build-up in casing 1408, a projectile disposed on or in a distal end of casing 1408 is propelled through the barrel of the firearm. In an embodiment, a flexible gas-tight seal may be used around the ramrod and the threaded hole to avoid escape of gas into the primer cavity.

Tubes, casings, puncturing devices, projectiles and other components disclosed herein may be manufactured by techniques known in the art, including, but not limited to, laser cutting and printing, CNC machining, additive manufacturing, injection molding, casting and the like.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps. All art-known functional equivalents of materials and methods are intended to be included in this disclosure.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a projectile" includes a plurality of such projectiles and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements, limitation or limitations which is/are not specifically disclosed herein.

What is claimed is:

1. A gas container comprising:

a cylindrical tube comprising a rounded, sealed end and an opposing, open end, an internal wall of the cylindrical tube comprising an internal flange; and a base configured to abut the internal flange and substantially seal the open end of the cylindrical tube;

wherein an outer diameter of the gas container at the open end is substantially equal to an outer diameter of the cylindrical tube at its mid-point.

2. The gas container of claim 1, wherein an outer diameter of the base is substantially equal to an inner diameter of the gas container at the open end.

3. The gas container of claim 1, wherein the base comprises a raised edge for abutting the internal flange.

4. The gas container of claim 3, wherein the raised edge has a width substantially equal to a width of the internal flange.

5. The gas container of claim 1, wherein the base is substantially planar.

6. The gas container of claim 1, wherein the base comprises a substantially planar puncture plate.

7. The gas container of claim 1, wherein the base is removable from the cylindrical tube, thereby allowing the cylindrical tube to be reused.

8. The gas container of claim 1, wherein an exterior wall of the cylindrical tube extends beyond the internal flange, the exterior wall forming a collar and comprising at least one vent.

9. The gas container of claim 8, wherein the base is physically separated from an outer edge of the collar.

10. The gas container of claim 8, wherein the exterior wall of the cylindrical tube extends beyond the rounded, sealed end to form a second collar.

11. The gas container of claim 10, wherein the second collar comprises at least one vent.

12. The gas container of claim 1, wherein an exterior wall of the cylindrical tube extends beyond the rounded, sealed end, the exterior wall forming a collar and comprising at least one vent.

13. The gas container of claim 1, the gas container disposed at least partially within a casing.

14. The gas container of claim 13, further comprising a puncturing device disposed within an exterior wall of the cylindrical tube extending beyond the internal flange, the exterior wall comprising at least one vent.

15. The gas container of claim 14, wherein the puncturing device comprises a pointed head.

16. The gas container of claim 15, wherein the pointed head comprises one or more channels radiating from a tip of the pointed head.

17. The gas container of claim 14, wherein the puncturing device comprises a pointed head, a sabot, and a ramrod that extends at least partially through a primer hole of the casing.

18. The gas container of claim 12, further comprising a projectile mounted in or on an exterior wall of the cylindrical tube, the exterior wall extending beyond the rounded, sealed end and comprising at least one vent.

19. The gas container of claim 18, wherein the projectile comprises a mechanical cleaner selected from the group consisting of a wire, an abrasive pad, a scour pad, a brush, a cloth, a sponge, a wire mesh, a wire brush, feathers and combinations thereof.

20. The gas container of claim 18, wherein the projectile comprises a chemical selected from the group consisting of a detergent, a lubricant, an etchant, a wax, a sealant, a drying agent, an oil, a solvent, a conditioning agent and combinations thereof.

* * * * *